US005499905A

United States Patent [19]

Schmitz et al.

[11] Patent Number: 5,499,905

[45] Date of Patent: Mar. 19, 1996

[54] METALLIC COMPONENT OF A GAS TURBINE INSTALLATION HAVING PROTECTIVE COATINGS

[75] Inventors: Friedhelm Schmitz, Dinslaken; Norbert Czech, Essen; Bruno Deblon, Mülheim/Ruhr, all of Germany

[73] Assignee: Siemens Aktiengesellschaft, Munich, Germany

[21] Appl. No.: 406,662

[22] Filed: Mar. 20, 1995

Related U.S. Application Data

[62] Division of Ser. No. 798,871, Nov. 25, 1991, which is a continuation of Ser. No. 593,084, filed as PCT/DE89/00023, Jan. 19, 1989, abandoned.

[30] Foreign Application Priority Data

Feb. 5, 1988 [DE] Germany ..... 38 03 517.0

[51] Int. Cl.[6] ..... F01D 5/28

[52] U.S. Cl. ..... 416/241 R; 416/241 B; 428/627; 428/629; 428/633; 428/667; 428/678; 428/680

[58] Field of Search ..... 415/200; 416/241 R, 416/241 B; 428/627, 629, 633, 667, 678, 680

[56] References Cited

U.S. PATENT DOCUMENTS

| | | | |
|---|---|---|---|
| 3,649,225 | 3/1972 | Simmons, Jr. . | |
| 4,072,797 | 2/1978 | Gass et al. . | |
| 4,087,589 | 5/1978 | Bessen . | |
| 4,123,594 | 10/1978 | Chang . | |
| 4,123,595 | 10/1978 | Chang . | |
| 4,198,442 | 4/1980 | Gupta et al. . | |
| 4,248,940 | 2/1981 | Goward et al. . | |
| 4,284,688 | 8/1981 | Stüchli et al. . | |
| 4,313,760 | 2/1982 | Dardi et al. . | |
| 4.326,011 | 4/1982 | Goebel et al. . | |
| 4,477,538 | 10/1984 | Clarke . | |
| 4,485,151 | 11/1984 | Stecura . | |
| 4,639,399 | 1/1987 | Aprigliano | 416/241 B |
| 4,677,034 | 6/1987 | Luthra . | |
| 5,043,138 | 8/1991 | Darolia et al. . | |

FOREIGN PATENT DOCUMENTS

| | | |
|---|---|---|
| 2207198 | 6/1974 | France . |
| 2444559 | 7/1980 | France . |
| 2826910 | 4/1979 | Germany . |
| 2826909 | 4/1979 | Germany . |
| 3104581 | 1/1982 | Germany . |

*Primary Examiner*—Edward K. Look
*Assistant Examiner*—Christopher Verdier
*Attorney, Agent, or Firm*—Herbert L. Lerner; Laurence A. Greenberg

[57] ABSTRACT

A metallic component of a gas-turbine installation is formed of a nickel-based base material and at least two coating layers superimposed on the base material for improving corrosion-resistance thereof. The coating layers include a first layer having a composition and/or thickness for resisting corrosive attack of the nickel-based base material at temperatures of 600° C. to 800° C. (HTCII), and a second coating layer having a composition and/or thickness for resisting corrosive attack of the base material at temperatures of 800° C. to 900° C. (HTCI).

14 Claims, 4 Drawing Sheets

METALLIC COMPONENT OF A GAS TURBINE INSTALLATION HAVING PROTECTIVE COATINGS

CROSS-REFERENCE TO RELATED APPLICATION

This is a divisional application of Ser. No. 07/798,871, filed Nov. 25, 1991, which was a continuation of Ser. No. 07/593,084, abandoned filed Oct. 5, 1990, which was a continuation application of PCT Application PCT\DE89\0023, filed Jan. 19, 1989, in which the United States of America has been designated.

BACKGROUND OF THE INVENTION

1. Field of the Invention

The invention relates to a metallic component of a gas turbine installation, such as a turbine blade, which is formed of a nickel-based base material and at least two coating layers superimposed on the base material for improving corrosion-resistance thereof.

Many components exposed to hot gas, especially in gas turbines, are not only subject to thermal, mechanical and erosive stresses but also to corrosive influences to a marked extent. Deposits which form from salts and have an origin which can be traced to fuel and air impurities, lead, together with some gaseous substances, to corrosive damage by high-temperature corrosion (HTC). The causes of corrosion may be quite heterogeneous. On the one hand, the type and source of the fuel and, on the other hand, the composition of the combustion air determine the various forms of attack or aggression which are developed by different chemical mechanisms. In fuels, varying contents of sulfur in natural gases and crude oils, vanadium components in heavy oil, heavy metals in blast-furnace gas, and heavy metals and chlorides in coal gas can exert an influence. In the composition of combustion air, liquid and solid aerosols contained therein play a decisive role; thus, depending upon the site of the installation, the combustion air may contain heavy metals, alkalis and/or chlorides.

2. Description of the Related Art

Various coating layers, including multiple coatings for components exposed to hot gas, have become known heretofore in relatively great numbers for various purposes from the literature. In particular, U.S. Pat. No. 4,123,594 discloses metal objects with a gradated or progressive coating thereon. The innermost layer is a diffusion layer which contains chromium primarily. The gradated coating described in the German application is intended generally to protect the metal object from heat corrosion; in this case, corrosion tests at temperatures of approximately 925° C. are described.

German Published Non-Prosecuted Application 28 26 909 discloses a further double layer for metal objects undergoing such stresses, an inner partial layer thereof having the elements aluminum, chromium and yttrium as constituents. U.S. Pat. No. 3,649,225 also describes double layers which are intended to prevent high-temperature corrosion. In most conventional double layers, the generally thin lower layer does not itself offer protection against external attack but instead merely improves the durability and adhesion of the upper layer.

Conventional layer systems protect a component against oxidation and corrosion at very high temperatures, but intensive tests have shown that the heretofore known layers do not simultaneously protect against a different kind of corrosive attack at temperatures between 600° C. and 800° C. As FIG. 1 of the hereinafter-described drawing shows, and according to tests which have become known in the interim, there are, in fact, two different types of attack or aggression for high-temperature corrosion.

FIG. 1 shows that, in addition to the aforementioned high-temperature corrosion within a range of approximately 850° C. (hereinafter referred to as HTCI), for which heretoforeknown protective layers have been formed, another strong corrosion mechanism exists which has its maximum within a range of approximately 700° C. FIG. 1 is a plot diagram of the corrosion rate against temperature.

In certain types of operation of gas turbine installations, especially in cases wherein the turbine operates in a partial-load region for relatively long periods of time, the corrosion mechanism at 700° C. (hereinafter HTCII) plays a decisive role in the service life of components. It has in fact been found that this type of corrosion in partial-load operation gradually destroys the protective layers intended to protect against attacks at higher temperatures, so that, during later full-load operation at an even higher temperature, the components are exposed, unprotected, to the other attack mechanisms.

In German Published Prosecuted Application (DE-A) 31 04 581, reference has already been made to the additional problem of corrosion at lower temperatures in gas turbines. A solution to this problem which is proposed therein is to apply additionally a silicon-enriched layer on the outside of a layer forming aluminide which is corrosion-resistant at high temperatures, in order to improve the resistance to corrosion attacks at average or medium temperature. Such a construction is not suited for all applications, with respect to temperature distribution in gas-turbine component members.

SUMMARY OF THE INVENTION

It is accordingly an object of the invention to provide a combination of protective layers which makes a metal object even more resistant to both of the heretofore known attack mechanisms, HTCI and HTCII than heretofore, and thus increases the service life of the component.

With the foregoing and other objects in view, there is provided, a metallic component of a gas-turbine installation formed of a nickel-based base material and at least two coating layers superimposed on the base material for improving corrosion-resistance thereof, the coating layers comprising a first layer having means for resisting corrosive attack of the nickel-based base material at temperatures of 600° to 800° C. (HTCII), and a second coating layer having means for resisting corrosive attack of the base material at temperatures of 800° C. to 900° C. (HTCI).

In accordance with another feature of the invention, the means for resisting corrosive attack of the base material at temperatures of 600° to 800° C. is an alloy mainly containing chromium with aluminum and at least one of the elements cobalt, nickel, iron and manganese, and the means for resisting corrosive attack of the base material at temperatures of 800° to 900° C. is an alloy mainly containing chromium with aluminum, at least one of the elements cobalt and nickel, and a minor fraction of at least one element selected from the group consisting of rare earth elements, yttrium, tantalum, hefanium, scandium, zirconium, rhenium, and silicon.

In accordance with the features of the invention, thickness or composition of the first layer are characteristics for affording the effective protection against corrosion.

This construction is based on the recognition that components exposed to hot gas generally become cool on the inside, so that there is a temperature drop from the outermost layer into the interior of the component. The layer disposed farther inwardly is therefore initially formed so as to be resistant to the attack mechanism at the lower temperature, while the outer layer is intended to protect against corrosion at higher temperatures.

It should also be noted that a component need not, in principle, be provided with both layers over its entire surface area, if the temperature stress on individual region varies. Naturally, the invention is intended to include double coating of only some regions of the metal objects as well. The proposed disposition of the layers has-the advantage, however, that the service life of a component is increased in each case, even if the average attack mechanism prevailing at various locations of the component varies and is not known implicitly. If, for example, a particularly well-cooled region of the component is predominantly within the temperature range of about 700° C. even in full-load operation, then, the outermost protective layer, which is not optimized for this type of attack, is, in fact, gradually destroyed, however, the layer located beneath it then provides protection afterwards.

In accordance with another feature of the invention, the first coating layer is a diffusion layer applied to the base material and having a thickness greater than 0.130 mm, the diffusion layer consisting primarily of chromium and having additionally at least 10% (by weight) of at least one of the elements iron and manganese.

In accordance with a further feature of the invention, the diffusion layer is formed mainly of chromium and substantially 20 to 30% iron.

In accordance with an additional feature of the invention, the percentage of chromium is substantially 40%.

In accordance with again an added feature of the invention, the coating layer is a deposition layer formed by low-pressure plasma spraying.

In accordance with again an additional feature of the invention, the first coating layer has a composition (percentage by weight) of 15 to 50% chromium, less than 5% aluminum, 0.5 to 2% at least one element selected from the group of elements consisting of rare earths, yttrium, scandium, hafnium, zirconium, niobium, tantalum and silicon, and a remainder of at least one of the elements iron and nickel, as well as impurities resulting from manufacturing.

In accordance with yet another feature of the invention, the percentage of chromium is substantially 20 to 30%.

In accordance with yet a further of the invention, the percentage of aluminum is less than 3%.

In accordance with yet an added feature of the invention, the percentage of at least one element of the group consisting of rare earths, yttrium, scandium, hafnium, zirconium, niobium, tantalum and silicon is substantially 1%.

In accordance with yet an additional feature of the invention, the coating layer is a deposition layer.

In accordance with still another feature of the invention, the second coating layer has a composition (percentage by weight) of 15 to 40% chromium, 3 to 15% aluminum, 0.2 to 3% at least one element selected from the group of elements consisting of rare earths, yttrium, tantalum, hafnium, scandium, zirconium, niobium, rhenium and silicon, and a remainder of at least one of the elements cobalt and nickel, as well as impurities resulting from manufacturing.

In accordance with still a further feature of the invention, the percentage of chromium is substantially 20 to substantially 30%.

In accordance with still an added feature of the invention, the percentage of aluminum is substantially 7 to substantially 12%.

In accordance with still an additional feature of the invention, the percentage of at least one element of the group consisting of rare earths, yttrium, tantalum, hafnium, scandium, zirconium, niobium, rhenium and silicon is substantially 0.7%.

In accordance with a further feature of the invention, the second coating layer is formed by plasma spraying.

In accordance with an added feature of the invention, there is provided a diffusion barrier layer disposed between any two of the basic material and the first and second coating layers for reducing diffusion processes between compositions of material thereof.

In accordance with an additional feature of the invention, the diffusion barrier layer is formed of titanium nitride.

In accordance with again another feature of the invention, there are provided respective diffusion barrier layers disposed between the basic material and the first coating layer and between the first coating layer and the second coating layer.

In accordance with again a further feature of the invention, there is provided a ceramic thermal barrier layer having low thermal conductivity disposed on the second coating layer.

In accordance with again an added feature of the invention, the ceramic thermal barrier layer is formed of zirconium oxide with an addition of yttrium oxide.

In accordance with again an additional feature of the invention, the second coating layer has a surface preoxidized to form the ceramic thermal barrier layer.

In accordance with a another feature of the invention, the coating layers have a total thickness greater than 0.3 mm.

In accordance with a concomitant feature of the invention, the component is a gas-turbine blade.

Other features which are considered as characteristic for the invention are set forth in the appended claims.

Although the invention is illustrated and described herein as embodied in a metallic component of a gas turbine installation having protective coatings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
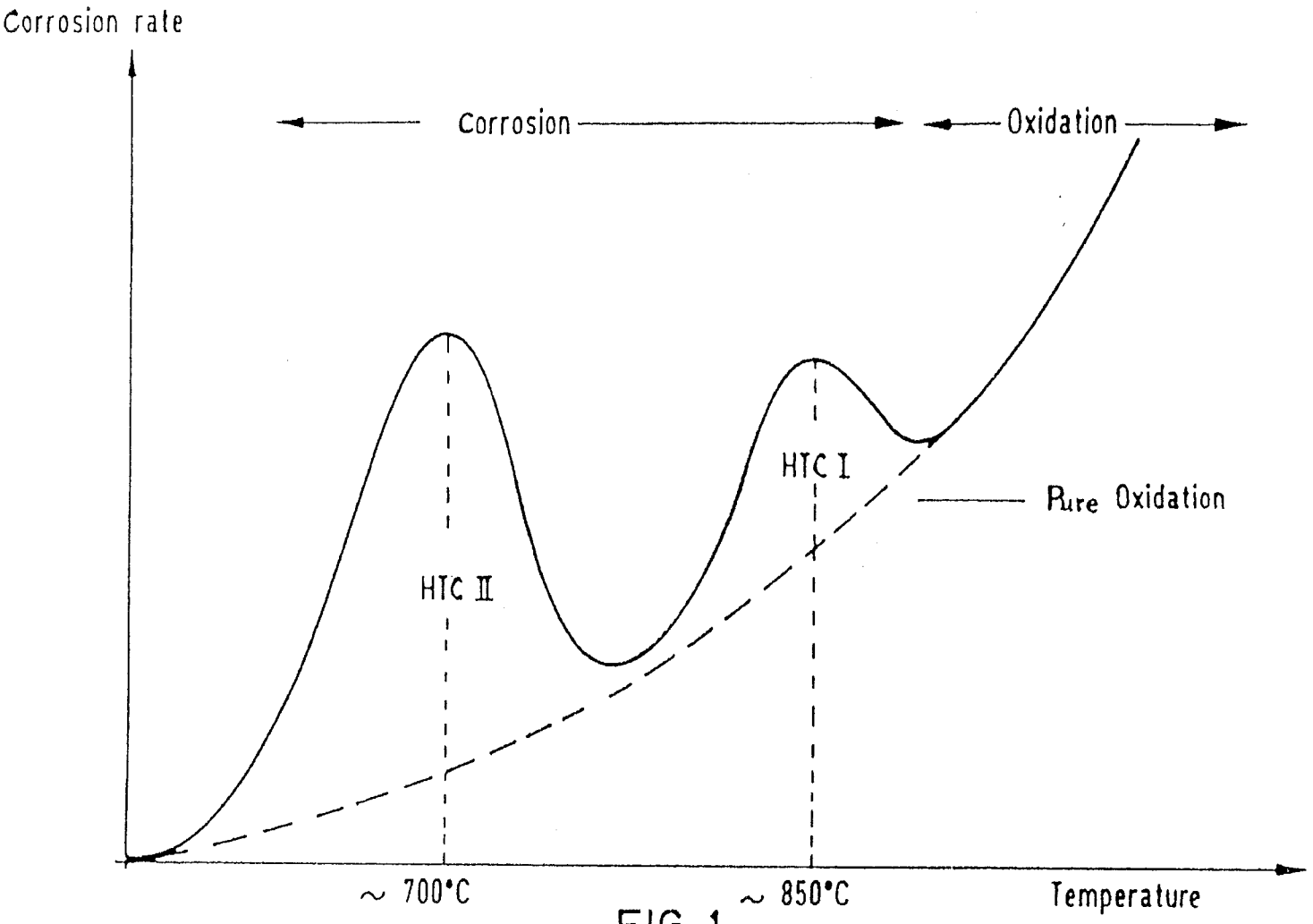
FIG. 1 is a plot diagram of the rate of corrosion against temperature in accordance with the state of the art.
Figure 2:
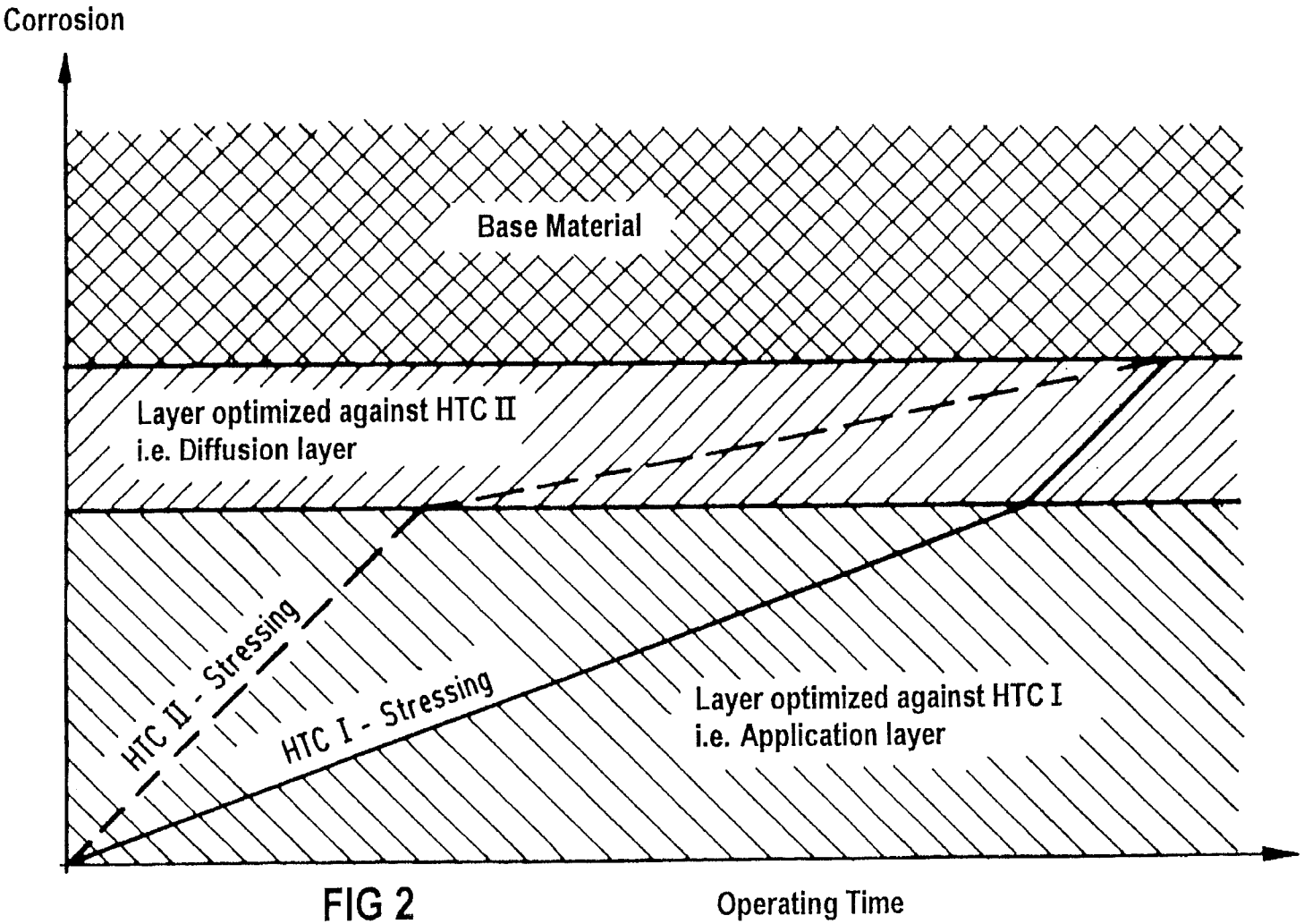
FIG. 2 is a plot diagram showing by way of example the effects of the double layer on the running or operating time. In this diagram, the corrosion wear is plotted against the running or operating time, and typical corrosion-wear curves for various temperature stresses of various partial regions of a component are illustrated.
Figure 3:
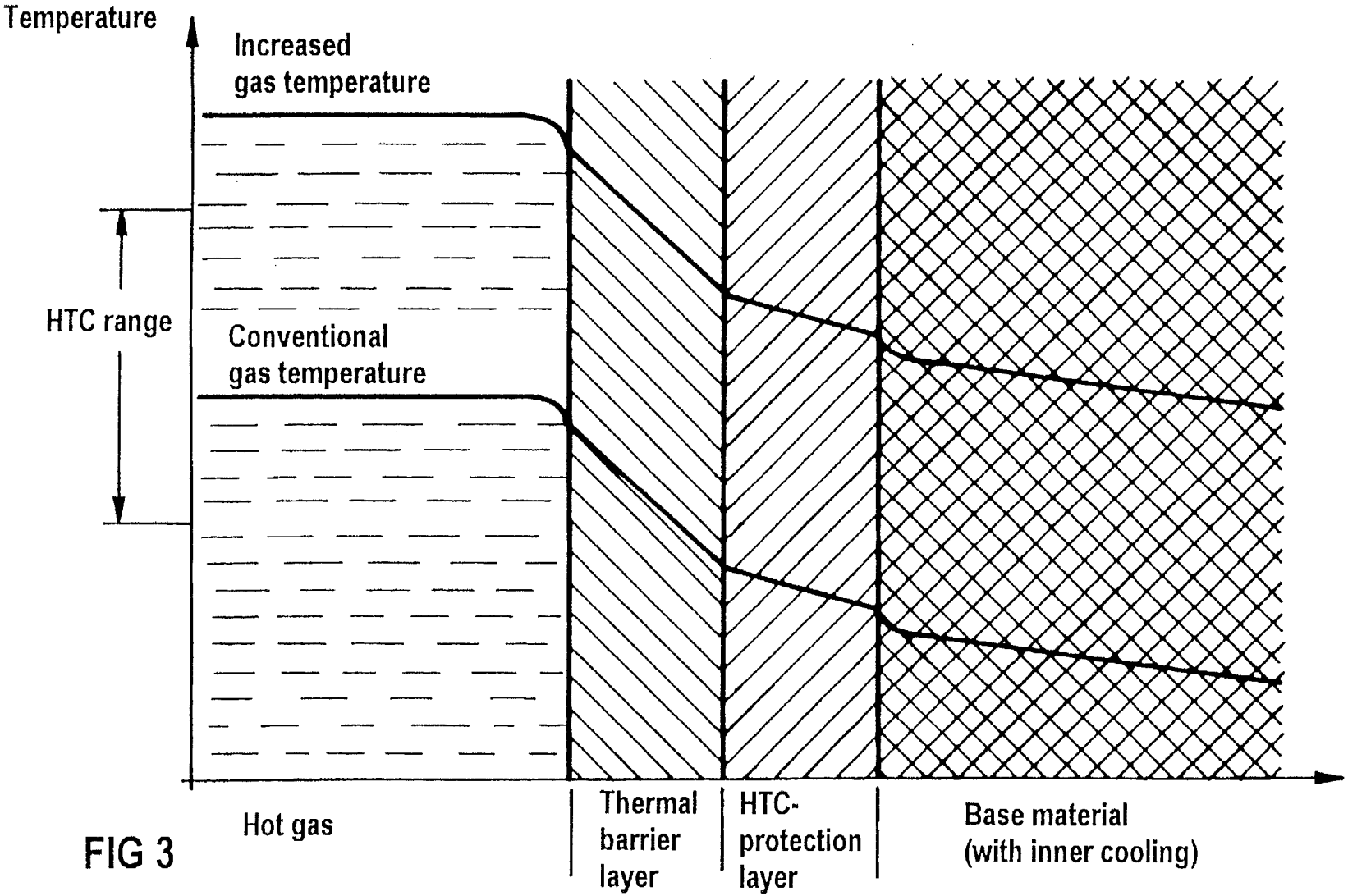
FIG. 3 shows the effect of a thermal barrier layer over a corrosion protection layer for a component cooled on the inside. The diagram shows two typical temperature profiles inside and outside the component and protective layers.

A diffusion layer having a chromium content of greater than 50%, which is applied to a metal object, is suitable as a first coating layer. Such diffusion layers are known per se from the prior art, in particular from the aforementioned U.S. Pat. No. 4,123,594. The favorable effect thereof against HTCII in combination with a second coating layer protecting against HTCI had been unrecognized heretofore. By means of an additional constituent of iron or manganese, for example, 10 to 30% (all the following figures are percentages by weight), the thickness of such a diffusion layer can be increased to more than 0.130 mm and, with an increasing constituent of iron or manganese, the possible layer thickness increases as well, which naturally increases the service life under HTCII conditions.

Instead of a first coating layer in the form of a diffusion layer, it is alternatively also possible to provide an applied layer which can, for example, be applied by low-pressure plasma spraying. This layer should contain from to 30 to 55% and preferably approximately 1% of at least one of the elements of the group consisting of the rare earths, yttrium, scandium, hafnium, zirconium, niobium, tantalum and silicon. Aluminum, if present at all, should consist of only small quantities, namely less than 5% and preferably even less than 3%. The remainder of the layer is formed of one of or a mixture of the elements iron, cobalt, and nickel, and impurities unavoidably produced during manufacture may be included.

If no cobalt is used for the first coating layer, but instead only one of the elements iron and nickel or a mixture thereof to attain equally good action, the chromium content can be selected to be lower, namely between 15 and 50%, and preferably approximately between 20 and 30%.

Furthermore, the second coating layer should belong to the type known as MCrAlY. Such layers are also basically known per se from the prior art, such as, again from the aforementioned German Published Non-Prosecuted Patent Application 28 26 910. The recognition that such a coating layer can be used not only to optimize against HTCI but also in combination with a layer located therebeneath which is optimized against HTCII, cannot be learned, however, from the prior art. Yet, precisely this combination results in a particularly long service life of the metal objects at locally different temperatures. According to the invention, the second applied layer should have the following composition: 15 to 40% chromium, preferably approximately 7 to 12%; 0.2 to 3% of at least one element selected from the group consisting of rare earths, yttrium, tantalum, hafnium, scandium, zirconium, niobium, rhenium, and silicon, preferably approximately 0.7%; and the remainder at least one of the elements cobalt or nickel, as well as impurities unavoidably produced during manufacture.

Furthermore, the second coating layer may be applied by plasma spraying, and especially by low-pressure plasma spraying. In principle, various coating processes are possible, such as those previously described in German Published Non-Prosecuted Patent Application 28 26 910, however, low-pressure plasma spraying permits the application of particularly well-adhering and oxide-free layers of relatively great layer thickness. Accordingly, the outer coating layer may have a greater layer thickness than the inner coating layer.

In contrast with the prior art, in which all the various coating layers are supposed to be bonded both to the metal object or metallic component and to one another by diffusion, it is important for the layers optimized in accordance with the invention, and for their durability, to prevent diffusion processes from taking place between the layers by means of a diffusion barrier layer. With layers optimized very precisely for given conditions, it is undesirable for the concentrations of individual ingredients, such as chromium or aluminum, to be equalized by diffusion, because the specific properties of the individual layers can be lost as a result. A diffusion barrier layer can thus markedly increase the service life. Such a layer may, for example, be formed of titanium nitride or titanium carbide.

Particularly with metal objects or metallic components cooled on the inside, one possibility for protection against particularly high temperatures is to prevent the temperatures from reaching the metallic layers at all. This can be attained by providing thermal barrier layers on the outside of the metal object. The effect of these layers is that the metal layers beneath them then have only those temperatures for which they have been designed. To prevent the possible-flaking-off of the thermal barrier layer, it is advantageous, in accordance with the invention, to oxidize the second coating layer on its surface prior to the application of the thermal barrier layer.

By coating a component in accordance with the invention, total layer thicknesses of over 0.3 mm are attainable.

Figure 4:
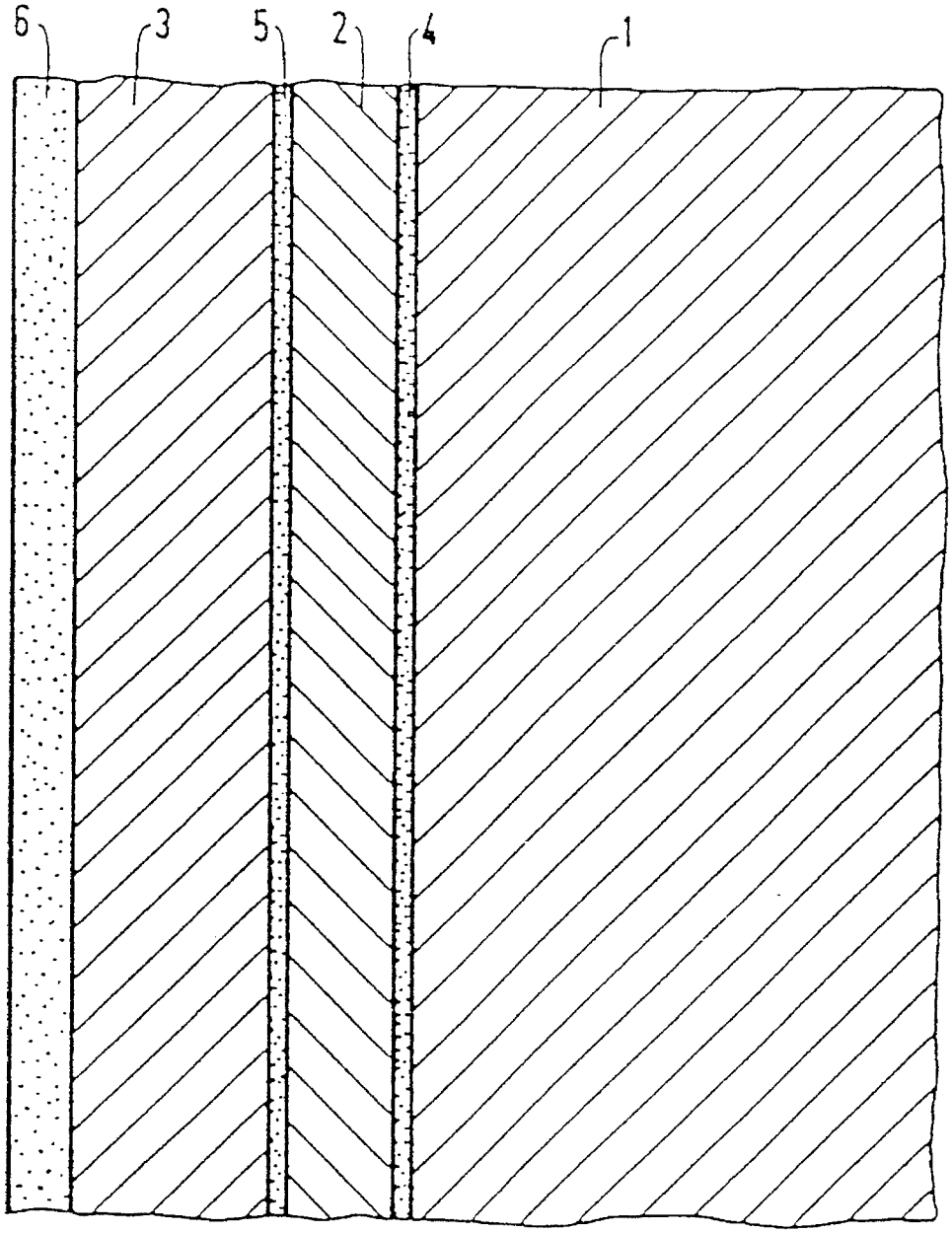
FIG. 4 is a cross-sectional view of a metal object with coating layers according to the invention.

In the exemplary embodiment of the invention diagrammatically shown in FIG. 4, a component or metal object 1 has a first metal coating layer 2, which is optimized against HTCII or resistant to it because of its thickness. Superimposed on the coating layer 2 is a second coating layer 3, which is resistant to HTCI. If necessary, respective diffusion barrier layers 4 and 5 may be provided between the basic material 1 and the first coating layer 2 and/or between the first coating layer 2 and the second coating layer 3, the diffusion barrier layers 4 and 5 preventing equalization of concentration of individual elements by diffusion. Finally, a thermal barrier layer 6, which protects against particularly high temperatures, can be provided on the outermost surface.

The foregoing is a description corresponding in substance to German Application P 38 03 517.0, dated Feb. 5, 1988, the International priority of which is being claimed for the instant application, and which is hereby made part of this application. Any material discrepancies between the foregoing specification and the aforementioned corresponding German application are to be resolved in favor of the latter.

We claim:

1. A metallic gas-turbine blade formed of a nickel-based base material which is cooled on the inside and which is provided, at least in a subregion thereof, with:

a) a first coating layer protecting against corrosion at temperatures of 600° to 800° C., said first coating layer being a diffusion layer applied to the base material and having a thickness greater than 0.130 mm, said diffusion layer consisting primarily of chromium and having additionally at least 10% of at least one of the elements iron and manganese; and b) a second coating layer superimposed on said first coating layer for protecting against corrosion at temperatures of 800° to 900° C., said second coating layer being a deposition layer and having a composition in percent by weight of 15 to 40% chromium, 7 to 15% aluminum, 0.2 to 3% at least one element selected from the group of elements consisting of rare earths, yttrium, tantalum, hafnium, scandium, zirconium, niobium, rhenium and silicon, and a remainder of at least one of the elements cobalt and nickel, as well as impurities resulting from manufacturing.

2. The gas-turbine blade according to claim 1, wherein said first coating layer contains substantially 20 to 30% iron.

3. The gas-turbine blade according to claim 1, including a diffusion barrier layer disposed between any two of said basic material and said first and said second coating layers for reducing diffusion processes between respective compositions of materials thereof.

4. The gas-turbine blade according to claim 3, wherein said diffusion barrier layer is formed of titanium nitride.

5. The gas-turbine blade according to claim 1, including a ceramic thermal barrier layer having low thermal conductivity disposed on said second coating layer.

6. The gas-turbine blade according to claim 5, wherein said ceramic thermal barrier layer is formed of zirconium oxide with an addition of yttrium oxide.

7. The gas-turbine blade according to claim 5, wherein said second coating layer has a surface preoxidized to form said ceramic thermal barrier layer.

8. The gas-turbine blade according to claim 1, wherein said coating layers have a total thickness greater than 0.3 mm.

9. A metallic gas-turbine blade formed of a nickel-based base material which is cooled on the inside and which is provided, at least in a subregion thereof, with:

a) a first coating layer protecting against corrosion at temperatures of 600° to 800° C., said first coating layer being a deposition layer having a composition in percent by weight of 30 to 55% chromium, less than 3% aluminum, 0.5 to 2% of at least one element selected from the group of elements consisting of rare earths, yttrium, tantalum, hafnium, scandium, zirconium, niobium and silicon, and a remainder of at least one of the elements iron, cobalt and nickel, as well as impurities resulting from manufacturing;

b) a second coating layer superimposed on said first coating layer for protecting against corrosion at temperatures of 800° to 900° C., said second coating layer having a composition in percent by weight of 15 to 40% chromium, substantially 7 to 15% aluminum, 0.2 to 3% of at least one element selected from the group of elements consisting of rare earths, yttrium, tantalum, hafnium, scandium, zirconium, niobium, rhenium and silicon, and a remainder of at least one of the elements cobalt and nickel, as well as impurities resulting from manufacturing; and c) a diffusion barrier layer disposed between any two of said basic material and said first and said second coating layers for reducing diffusion processes between respective compositions of materials thereof.

10. A metallic gas-turbine blade formed of a nickel-based base material which is cooled on the inside and which is provided, at least in a subregion thereof with:

a) a first coating layer protecting against corrosion at temperatures of 600° to 800° C., said first coating layer being a deposition layer having a composition in percent by weight of 15 to 30% chromium, less than 5% aluminum, 0.5 to 2% of at least one element selected from the group of elements consisting of rare earths, yttrium, tantalum, hafnium, scandium, zirconium, niobium and silicon, and a remainder of at least one of the elements iron and nickel, as well as impurities resulting from manufacturing;

b) a second coating layer superimposed on said first coating layer for protecting against corrosion at temperatures of 800° to 900° C., said second coating layer having a composition in percent by weight of 15 to 40% chromium, substantially 7 to 15% aluminum, 0.2 to 3% of at least one element selected from the group of elements consisting of rare earths, yttrium, tantalum, hafnium, scandium, zirconium, niobium, rhenium and silicon, and a remainder of at least one of the elements cobalt and nickel, as well as impurities resulting from manufacturing; and c) a diffusion barrier layer disposed between any two of said basic material and said first and said second coating layers for reducing diffusion processes between respective compositions of materials thereof.

11. The gas-turbine blade according to claim 9, wherein said diffusion barrier layer is formed of titanium nitride.

12. The gas-turbine blade according to claim 10, wherein said diffusion barrier layer is formed of titanium nitride.

13. Metallic component of a gas-turbine installation formed of a nickel-based base material and at least two coating layers superimposed on the base material for improving corrosion-resistance thereof, the coating layers comprising a first layer having first means for resisting corrosive attack of the nickel-based base material at temperatures of 600° to 800° C., a second coating layer having second means for resisting corrosive attack of the base material at temperatures of 800° C. to 900° C., and a diffusion barrier layer formed of titanium nitride disposed between any two of said basic material and said first and second coating layers for reducing diffusion processes between respective compositions of materials thereof.

14. The gas-turbine blade according to claim 13, wherein said first means is an alloy mainly containing chromium with aluminum and at least one of the elements cobalt, nickel, iron and manganese and said second means is an alloy mainly containing chromium with aluminum, at least one of the elements cobalt and nickel, and a minor fraction of at least one element selected from the group consisting of rare earth elements, yttrium, tantalum, hafnium, scandium, zirconium, rhenium, and silicon.

* * * * *